US011644282B2

(12) United States Patent
Kalinski et al.

(10) Patent No.: US 11,644,282 B2
(45) Date of Patent: May 9, 2023

(54) GARMENT WITH CAMOUFLAGE ATTACHMENT SYSTEM

(71) Applicant: Bush Ninja Gear Ltd., Calgary (CA)

(72) Inventors: Kelsey James Kalinski, Lacombe County (CA); Jason Michael Panas, Sherwood Park (CA)

(73) Assignee: Bush Ninja Gear Ltd., Calgary (CA)

( * ) Notice: Subject to any disclaimer, the term of this patent is extended or adjusted under 35 U.S.C. 154(b) by 1151 days.

(21) Appl. No.: 16/248,147

(22) Filed: Jan. 15, 2019

(65) Prior Publication Data

US 2019/0219366 A1 Jul. 18, 2019

Related U.S. Application Data

(60) Provisional application No. 62/617,922, filed on Jan. 16, 2018.

(51) Int. Cl.

| | |
|---|---|
| ***F41H 3/02*** | (2006.01) |
| ***A45F 5/02*** | (2006.01) |
| ***A41D 15/04*** | (2006.01) |
| ***A41D 15/00*** | (2006.01) |
| ***A41D 27/08*** | (2006.01) |

(52) U.S. Cl.

CPC ..... *F41H 3/02* (2013.01); *A41D 15/00* (2013.01); *A41D 15/04* (2013.01); *A45F 5/02* (2013.01); *A41D 27/08* (2013.01); *A41D 2300/32* (2013.01); *A41D 2600/108* (2013.01); *A45F 2005/023* (2013.01)

(58) Field of Classification Search

CPC ..... A45F 5/02; A45F 2005/023; A41D 2600/108; A41D 27/08

See application file for complete search history.

(56) References Cited

U.S. PATENT DOCUMENTS 2,351,142 A * 6/1944 Mitchell ..... F41H 3/02 428/141
2,744,348 A * 5/1956 Smith ..... A01M 31/00 40/586
4,517,230 A * 5/1985 Crawford ..... F41H 3/00 428/17
4,792,471 A * 12/1988 Lee ..... F41H 3/00 428/17
5,010,589 A * 4/1991 Hamilton ..... A41D 15/00 D5/43
5,159,718 A * 11/1992 Moyer ..... A41D 13/01 2/172
5,203,033 A 4/1993 Sheppard, Sr. et al.
5,274,848 A * 1/1994 Shamblin ..... F41H 3/00 2/69

(Continued)

FOREIGN PATENT DOCUMENTS

GB 2511135 A 8/2014

*Primary Examiner* — Alissa J Tompkins
*Assistant Examiner* — Brieanna Szafran
(74) *Attorney, Agent, or Firm* — Heslin Rothenberg Farley & Mesiti P.C.

(57) ABSTRACT

The invention provides a size-adjustable garment configured for attachment of camouflage elements and/or accessories using a plurality fastening elements. One or more of the fastening elements are configured to simultaneously provide a mechanism for adjusting the size of the garment and to provide a mechanism for attachment of the camouflage elements and/or accessories.

17 Claims, 9 Drawing Sheets

(56) References Cited

U.S. PATENT DOCUMENTS

| | | | | |
|---|---|---|---|---|
| 5,638,544 | A | 6/1997 | Sump | |
| 5,742,985 | A | 4/1998 | Larrabee | |
| 6,060,142 | A * | 5/2000 | Rossini | F41H 3/00 428/193 |
| 7,065,793 | B1 * | 6/2006 | Wooten | A41D 13/00 2/69 |
| 7,076,806 | B1 | 7/2006 | Van Winkle et al. | |
| 7,168,103 | B2 * | 1/2007 | Aldridge | A62B 17/001 2/458 |
| 7,426,755 | B2 * | 9/2008 | Grilliot | A62B 17/003 2/81 |
| 8,341,772 | B1 | 1/2013 | Flores | |
| 8,359,664 | B2 | 1/2013 | Morgan et al. | |
| 8,453,267 | B1 * | 6/2013 | Stanley | A41D 1/067 2/244 |
| 9,033,021 | B2 | 5/2015 | Hand | |
| 9,709,362 | B2 | 7/2017 | Shelley | |
| 2005/0044610 | A1 * | 3/2005 | Grimes | A41D 1/06 2/244 |
| 2009/0242597 | A1 * | 10/2009 | Morgan | A45F 5/02 29/525.01 |
| 2009/0307878 | A1 * | 12/2009 | Kadas | A45F 5/02 24/304 |
| 2011/0247121 | A1 | 10/2011 | Cart | |
| 2012/0152095 | A1 | 6/2012 | Youngman | |
| 2013/0205468 | A1 * | 8/2013 | Ceo | A41D 13/0002 2/94 |

* cited by examiner

GARMENT WITH CAMOUFLAGE ATTACHMENT SYSTEM

CROSS-REFERENCE TO RELATED APPLICATIONS

This application claims priority to U.S. Provisional Application Ser. No. 62/617,922 filed on Jan. 16, 2018, the entire disclosure of which is incorporated herein by reference.

FIELD OF THE INVENTION

The invention relates to camouflage and more particularly a garment providing a system which allows natural camouflage elements and accessories to the garment.

BACKGROUND

Camouflage techniques are used by sport hunters, military personnel and other recreational activities gaining popularity such as paintball. Clothing is available with disruptive patterns that break up a wearer's outline, in colors suitable for blending into many different environments. Ghillie suits are used by military personnel and are based on webs to which foliage can be attached. In other camouflage systems foliage is attached using retention devices such as netting or bands on helmets. Using natural foliage allows camouflage wearers to adapt their camouflage to changing environments.

GB 251135 describes a pouch for retaining and dispensing camouflage material which is primarily described for camouflaging a helmet.

U.S. Pat. No. 5,203,033 describes elongated connectors to form connector loops for holding camouflage elements formed of simulated leaves.

U.S. Pat. No. 5,638,544 describes a helmet with a camouflage band retaining system.

U.S. Pat. No. 5,742,985 describes a clip-on camouflage outfit accessory formed of a base being coupled to a user's item of camouflage clothing and a branch clip to secure small branches of foliage.

U.S. Pat. No. 7,076,806 describes a body armor accessory which has some elongated members extending laterally across at least about half of the trunk of the body armor accessory for tightening the armor against the trunk.

U.S. Pat. No. 8,341,772 describes a workout garment which has a plurality of supporting straps for providing customizable support to shoulders and arms.

U.S. Pat. No. 8,359,664 is a patent document identified earlier by you and located in the search. This document describes a device with elastomeric banding with a backing plate to provide tension to immobilize camouflage material.

U.S. Pat. No. 9,033,021 describes a hunting blind which adapts to different hunting areas by providing straps to hold natural vegetation items.

U.S. Pat. No. 9,709,362 describes a frame for holding camouflage material.

US 20110247121 describes surface area camouflage items with camouflage designs or patterns printed thereon. These items are attachable to items of clothing.

US 20120152095 describes a mesh-based camouflage apparatus for attachment of camouflage elements.

There continues to be a need for improved systems for placement of camouflage elements on a garment used to hide the user from view during sport hunting or other recreational activities benefiting from the use of camouflage.

SUMMARY

One aspect of the invention is a garment configured for attachment of camouflage elements and/or accessories to the garment using a fastening element, the fastening element comprising: a first strip of flexible material substantially connected to and conforming with the outer surface of the garment and having an outward-facing fastening surface; and a second strip of flexible material having a garment-anchored end and a free end, the garment-anchored end adjacent to or overlapping with one of the ends of the first strip, the second strip of flexible material having an inward-facing fastening surface configured to fasten to the outward-fastening surface of the first strip to hold camouflage elements and/or accessories therebetween.

In some embodiments, the first strip is attached to the garment across substantially its entire length to provide an outward-facing fastener surface which conforms to the outer surface of the garment.

In some embodiments, the second strip comprises a secondary attachment mechanism for holding one or more additional camouflage elements or accessories against an outward facing surface of the second strip.

In some embodiments, the secondary attachment mechanism comprises one or more loops configured to extend outward from the second strip.

In some embodiments, the loops are formed from opposed slits formed in the second strip.

In some embodiments, the first strip and the second strip are integrally formed or attached to each other at the garment anchored end.

In some embodiments, the outward-fastening surface and the inward fastening surface are complementary fastening surfaces.

In some embodiments, the complementary fastening surfaces are hook and loop fastening surfaces.

Another aspect of the invention is a garment configured for attachment of camouflage elements and/or accessories to the garment using a fastening element, the fastening element comprising: a first strip of flexible material substantially connected to and conforming with the outer surface of the garment and having an outward-facing fastening surface; and second and third strips of flexible material, each having a garment-anchored end and a free end, the garment-anchored end of the second strip adjacent to or overlapping with one end of the first strip and the garment-anchored end of the third strip adjacent to or overlapping with the other end of the first strip, the second and thirds strip of flexible material each having an inward-facing fastening surface configured to fasten to the outward-fastening surface of the first strip to hold camouflage elements and/or accessories therebetween.

In some embodiments, the first strip is attached to the garment across substantially its entire length to provide an outward-facing fastener surface which conforms to the outer surface of the garment.

In some embodiments, the second and third strips each comprise a secondary attachment mechanism for holding one or more additional camouflage elements or accessories.

In some embodiments, the secondary attachment mechanism comprises one or more loops configured to extend outward from the second and third strips.

In some embodiments, the loops are formed from opposed slits formed in the second and third strips.

In some embodiments, the second strip and third strip are integrally formed or attached to the first strip at opposing ends of the first strip.

In some embodiments, the outward-fastening surface and the inward fastening surface are complementary fastening surfaces.

In some embodiments, the complementary fastening surfaces are hook and loop fastening surfaces.

In some embodiments, the garment is an upper body or lower body garment.

Another aspect of the invention is an upper body garment having a plurality fastening elements as recited in any one of claims 1 to 16.

In some embodiments, the fastening elements are connected to the trunk of the upper body garment.

In some embodiments, the garment further comprises additional fastening elements connected to at least one of the arms of the upper body garment.

In some embodiments, the garment further comprises additional fastening elements connected to at least one of the shoulders of the upper body garment.

Another aspect of the invention is a method for compressing the garment as described herein against a part of the body of an individual wearing the garment, the method comprising: grasping at least the second strip and pulling the free end of the second strip towards an opposing end of the first strip; folding excess fabric of the garment beneath the fixed strip and fastening the inward-facing fastening surface of the second strip to the outward-facing fastening surface of the first strip.

Another aspect of the invention is a size-adjustable garment configured for attachment of camouflage elements and/or accessories using a plurality of fastening elements configured to simultaneously provide a mechanism for adjusting the size of the garment and to provide a mechanism for attachment of the camouflage elements and/or accessories.

One or more of the fastening elements may each comprise: a strip of flexible material connected to the garment at a first end and having a free second end, the strip having an outward fastening surface adjacent to the first end and an inward fastening surface adjacent to the second end, wherein the outward and inward fastening surfaces become fastenable to each other when a fold is made in the strip between the first end and the second end; a rigid member anchored to the garment in an arrangement permitting the fold in the strip to be made around the rigid member such that the second end can be pulled towards the first end as the strip rolls over the rigid member, the rigid member being pulled towards the first end of the strip, thereby causing folding of a portion of the garment between the rigid member and the first end of the strip.

The strip of the fastening element may include a secondary attachment mechanism for holding one or more additional camouflage elements or accessories against an outward facing surface of the strip when the outward and inward fastening surfaces are fastened.

The secondary attachment mechanism may include one or more loops. The loops may be formed from opposed slits formed in the strip or may be formed of elastomeric material connected to the outward facing surface of the strip.

The outward and inward fastening surfaces may be complementary fastening surfaces such as hook and loop fastening surfaces.

The rigid member may be provided as part of a square or rectangular ring anchored to the garment.

An additional segment of outward fastening surface material may be attached to the garment adjacent to the first end of the strip for fastening to the inward fastening portion of the strip if the fold permits the second end to extend beyond the first end.

Another aspect of the invention is an upper body garment which includes six fastening elements as described herein with three fastening elements arranged in a vertical column on each side of a front torso portion of the garment.

Another aspect of the invention is an upper body garment which includes twelve fastening elements as described herein, arranged in two vertical columns of three fastening elements on each side of a front torso portion of the garment.

The upper body garment embodiments may include fastening elements on each sleeve of the upper body garment and may further include a plurality of additional loops located medially with respect to the three fastening elements on each side of the torso portion.

The upper body garment embodiments may include a plurality of upper loops located on the chest portion and shoulder portion of the upper body garment.

The upper body garment embodiments may include a loop located on an upper chest portion of the garment for connection of an animal call device to enable hands-free operation of the animal call device.

The upper body garment embodiments may have a distance of about 11 to about 13 inches between a side seam and a center line of the garment, wherein the fastening elements have strip lengths of about 8 inches to about 10 inches.

In certain embodiments, the rigid member of the fastening elements is formed of metal or plastic.

Another aspect of the invention is a method for adjusting the size of embodiments of the garment described herein against a part of the body of an individual wearing the garment. The method includes the steps of grasping the second end of the strip of the fastening element; wrapping the strip around the rigid member to create the fold and pulling the second end to pull the rigid member towards the first end of the strip, thereby folding and compressing the garment against the body of the individual; and fastening the inward fastening surface to the outward fastening surface.

The method may further include the step of placing a camouflage element and/or an accessory between the inward fastening surface and the outward fastening surface prior to the fastening step, thereby attaching the camouflage element and/or the accessory to the garment.

BRIEF DESCRIPTION OF THE DRAWINGS

Various objects, features and advantages of the invention will be apparent from the following description of particular embodiments of the invention, as illustrated in the accompanying drawings. The drawings are not necessarily to scale, emphasis instead being placed upon illustrating the principles of various embodiments of the invention. Similar reference numerals indicate similar components.

DETAILED DESCRIPTION

Rationale

Embodiments of the invention described herein are intended to simultaneously address two problems encountered in sport hunting or any other recreational activity which may require attachment of camouflage elements to outer clothing. The first problem addresses provision of a system for conveniently connecting camouflage elements and other small items of equipment used in sport hunting to an outer garment and the second problem addresses provision of an oversized sport hunting outer garment to allow a substantial mid-layer garment to be worn underneath during cold seasons and the ability to adjust the sizing to compress the extra outer garment material when a substantial mid-layer garment is not being worn underneath the over garment, as would be the case during warmer seasons. As such, embodiments of the garment with fastening elements described herein are useful for conveniently attaching camouflage elements and other small items of equipment used in sport hunting or other outdoor recreational activities and are adaptable for use in all four seasons.

Various aspects of the invention will now be described with reference to the figures. For the purposes of illustration, components depicted in the figures are not necessarily drawn to scale. Instead, emphasis is placed on highlighting the various contributions of the components to the functionality of various aspects of the invention. A number of possible alternative features are introduced during the course of this description. It is to be understood that, according to the knowledge and judgment of persons skilled in the art, such alternative features may be substituted in various combinations to arrive at different embodiments of the present invention.

Embodiment 1—Upper Body Garment with Long Fastening Elements on Front Torso

Features of a first embodiment of a garment 1 are now described with respect to FIGS. 1 to 4. In FIGS. 1A and 1B, there is shown an illustration of the front of the garment 1 which includes a series of fastening elements 5*a*-5*m* for attaching camouflage elements C or accessories A-1 and A-2 according to one embodiment. FIG. 1A shows the garment 1 prior to attachment of camouflage elements C and FIG. 1B shows the garment 1 after attachment of camouflage elements C and accessories A-1 and A-2.

Figure 1A:
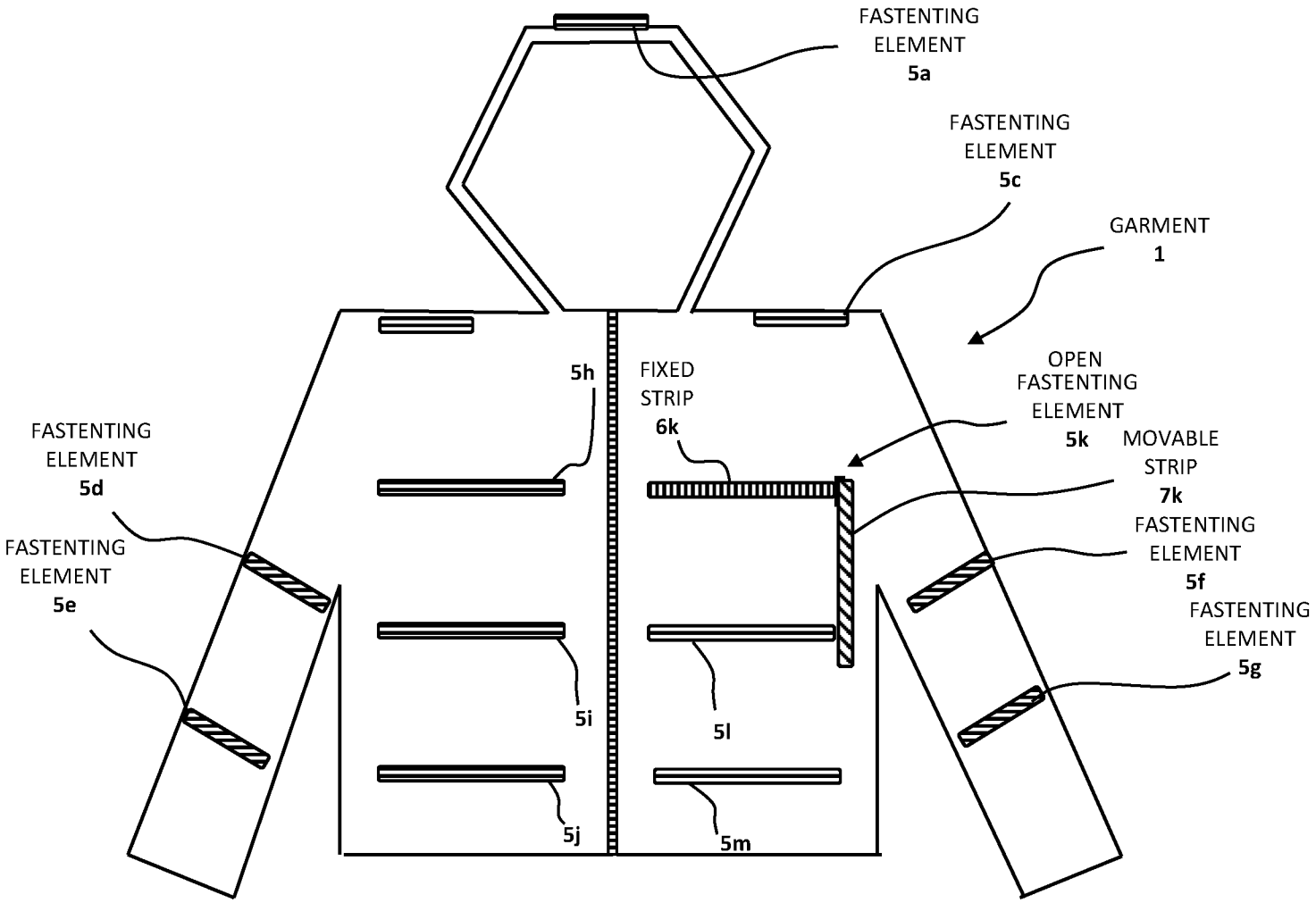
FIG. 1A is an illustration of a garment 1 with a plurality of fastening elements 5*a*-5*m* according to one embodiment of the invention.

It is to be understood that the specific configuration of the camouflage elements C and accessories A-1 and A-2 is by way of example. Fewer or more camouflage elements and fewer or more accessories may be attached using the fasteners 5*a*-5*m* according to the preferences of individual users. The locations of the fastening elements 5*a*-5*m* are to be considered as permanent (i.e. not removable from the garment for repositioning) but alternative embodiments within the scope of the invention will have fewer or more fastening elements at differing locations (including the back of the garment 1) and with significantly different dimensions while addressing the need for convenient attachment of camouflage elements and accessories. In addition, while FIGS. 1A and 1B depict an upper body garment 1 which may be a jacket or a poncho, the same principles are applicable to lower body garments such as pants or shorts, for example.

Figure 1B:
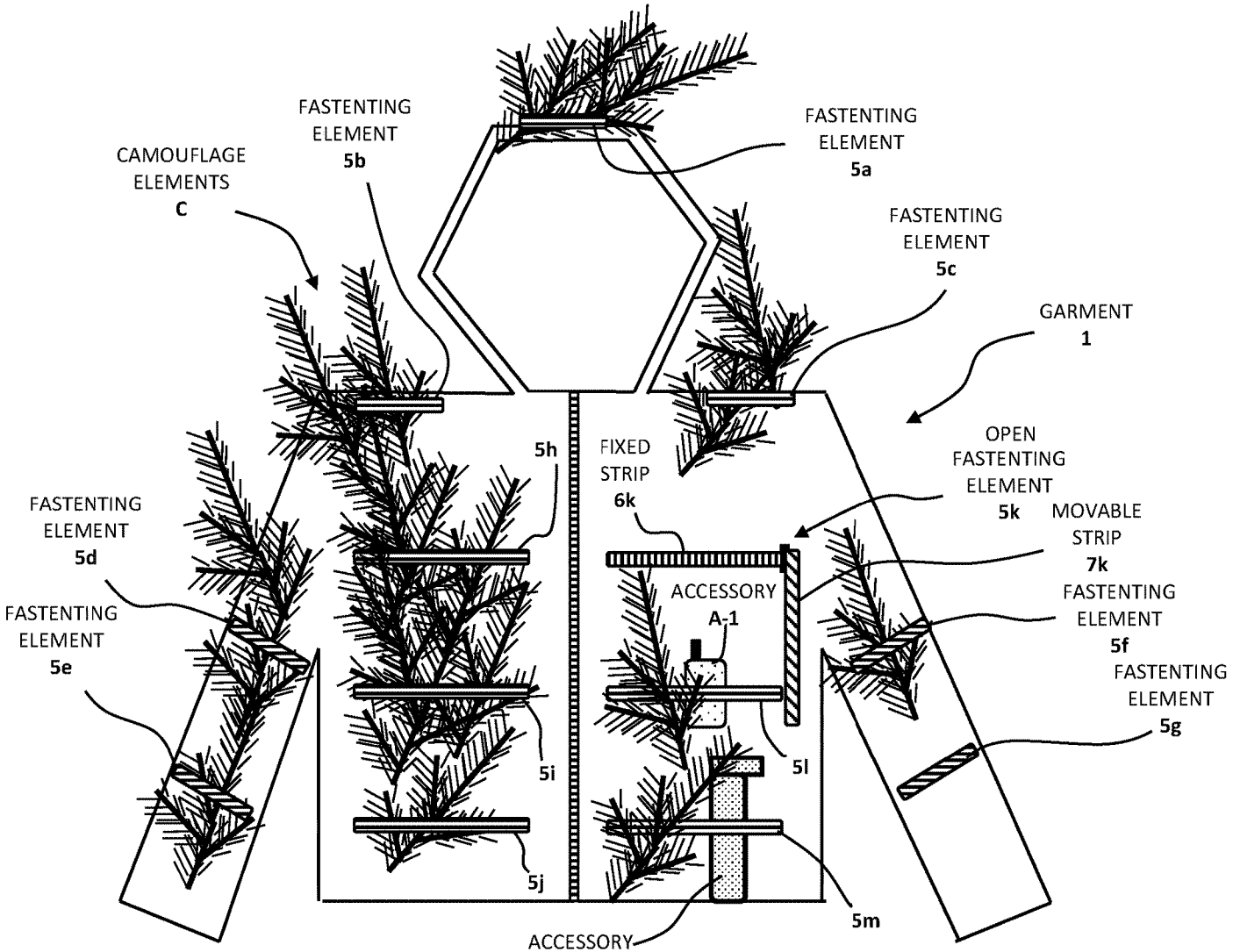
FIG. 1B is another illustration of garment 1 of FIG. 1A with attached camouflage elements C and accessories A-1 and A-2.

In FIG. 1B, camouflage elements C are attached to the garment 1 using fastening elements 5*a*-5*f*, 5*h*-5*j*, 5*l* and 5*m*. Fastening element 5*k* is shown in the open position which indicates a horizontal fixed strip 6*k* and a vertical movable strip 7*k* to the immediate right of the horizontal fixed strip 6*k* hanging downward from its anchored end. Accessory A-1 (a rangefinder) is attached to the garment 1 using fastening element 5*l* and accessory A-2 (a canister of bear pepper spray) is attached to the garment 1 using fastening element 5*m*. The mechanisms operation of the fastening elements will be described in more detail hereinbelow with reference to FIGS. 2 and 3. It can also be seen that the camouflage elements C connected to fastening elements 5*l* and 5*m* are connected to the outside of these fastening elements 5*l* and 5*m* to partially obscure the accessories A-1 and A-2 held in place by these fastening elements 5*l* and 5*m*. The mechanism of connecting camouflage elements C to the outside of fastening elements will also be discussed in more detail hereinbelow.

Figure 2:
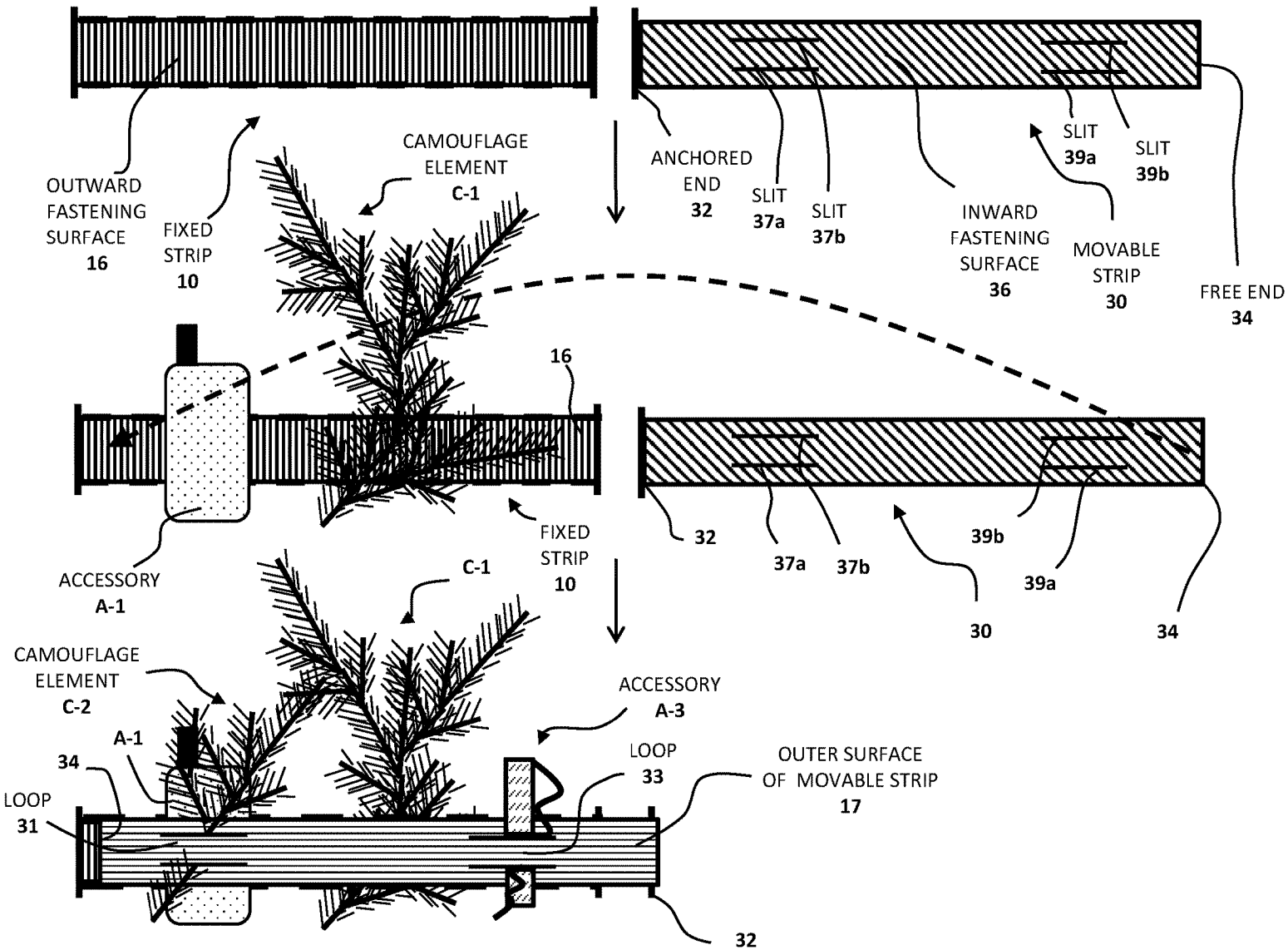
FIG. 2 illustrates a process for placement of accessories A-1, A-2 and camouflage elements C-1 and C-2 on one embodiment of a fastening element with a fixed strip 10 and a movable strip 30 having an anchored end 32 and a free end 34.

Referring now to FIG. 2, there is shown an illustration of a process for attaching accessories A-1 and A-3 and camouflage elements C-1 and C-2 to a fastening element comprising a fixed strip 10 which is connected to the outer surface of a garment (not shown but understood to be represented by the unlabeled background of FIG. 2 behind fixed strip 10) and a moveable strip 30 located to the right of the fixed strip 10. The connection of the fixed strip 10 in some embodiments is permanent and effected by stitching or other known means of connection such that the fixed strip 10 generally conforms to the outer surface of the garment. For example, if the garment is folded or rolled, the fixed strip 10 will also be folded or rolled. On the other hand, the movable strip 30 is connected to the garment only at anchored end 32 which is adjacent to an end of the fixed strip 10 (in this case, the right end of the fixed strip 10). The other end of movable strip 30 is a free end 34. In FIG. 2, there is shown a space between the fixed strip 10 and the anchored end 32 of the movable strip 30. In alternative embodiments, the fixed strip and the movable strip are connected at the anchor point (one example of such an embodiment will be described hereinbelow with respect to FIG. 3). While it will be recognized that provision of an anchored end or an internal anchored line on the movable strip is not absolutely necessary for the fastening function, it is advantageous in preventing the movable strip from being lost and for providing a garment adjustment mechanism as will be described hereinbelow with reference to FIG. 4.

The fixed strip 10 is provided with an outward fastening surface 16 and the movable strip 30 is provided with an inward fastening surface 36. In one embodiment the fastening surfaces 16 and 36 are complementary fastening surfaces such as the hook and loop surfaces of Velcro®, for example. Other types of fasteners with fastening properties having fastening effectiveness similar to the effectiveness of hook and loop fasteners are known and may be used to provide the fastening surfaces in alternative embodiments.

The movable strip 30 is provided in this embodiment with two pairs of opposing slits 37*a*, 37*b*, 39*a* and 39*b* formed entirely through the material of the movable strip 30 which creates loops 31 and 33 between them.

In the middle area of FIG. 2, accessory A-1 and camouflage element C-1 are placed against the outward fastening surface 16 of the fixed strip 10. Then the free end 34 of the movable strip 30 is pulled over to the left end of the fixed strip 10 as indicated by the dashed arrow. Then the inward fastening surface 36 is pressed against the outward fastening surface 16 of the fixed strip 10. This fastens the accessory A-1 and camouflage element C-1 in place on the garment.

In the bottom area of FIG. 2, a final arrangement is shown where camouflage element C-1 and accessory A-1 are sandwiched between the fixed strip 10 and the movable strip 30 with the outer surface 17 of the movable strip 30 being visible. Furthermore, a second camouflage element C-2 is held in place by loop 31 (to partially obscure accessory A-1 from view) and a second accessory A-3 is held in place by loop 33.

Figure 3:
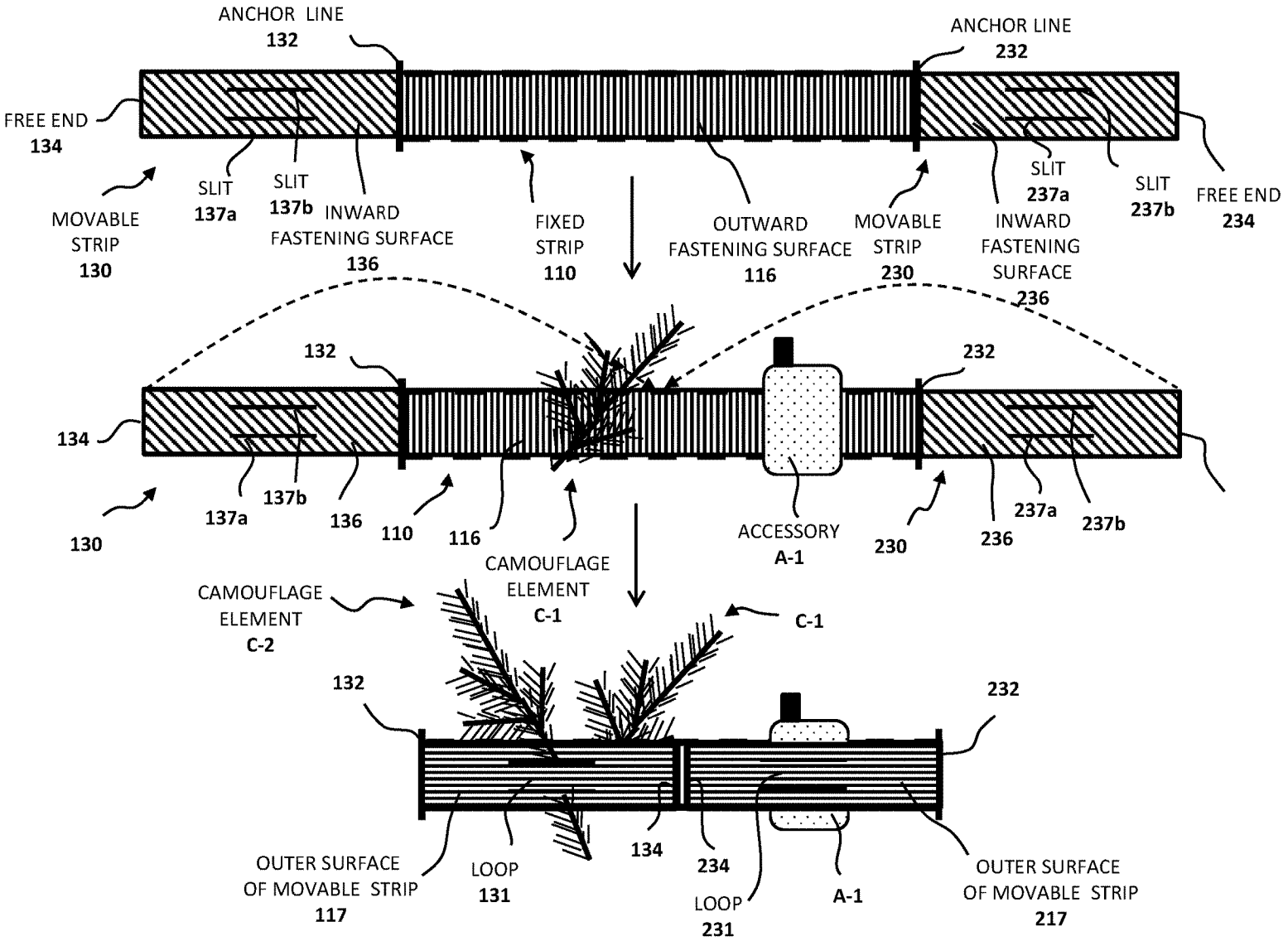
FIG. 3 illustrates a process for using a different embodiment of the fastening element to attach an accessory A-1 and two camouflage elements C-1 and C-2.

An alternative embodiment of a fastening element is shown in FIG. 3. This fastening element embodiment has a single fixed strip 110 with outer movable strips 130 and 230. The left end of the fixed strip 110 is connected to or formed integrally with movable strip 130 at anchor line 132 and the left end of the movable strip 130 is free end 134. Likewise, the right end of the fixed strip 110 is connected or formed integrally with movable strip 230 at anchor line 232 and the right end of the movable strip 130 is free end 234. The fixed strip 110 has an outward fastening surface 116 and the two movable strips 130 and 230 each have inward fastening surfaces 136 and 236. Each of the two movable strips 130 and 230 is provided with a pair of slits 137*a*, 137*b* and 237*a*, 237*b*.

In the middle part of FIG. 3, it is seen that camouflage element C-1 and accessory A-1 are placed against the outward fastening surface 116 of the fixed strip 110. Then the free ends 134 and 234 are pulled over toward the center of the fixed strip 110 and the inward fastening surfaces 136 and 236 are pressed against the outward fastening surface of the fixed strip 110 to hold the camouflage element C-1 and the accessory A-1 in place. In the bottom part of FIG. 3, it is seen that the outer surfaces 117 and 217 of the movable strips 130 and 230 are facing outward and a second camouflage element C-2 is placed in loop 131. Loop 231 remains free for placement of an additional camouflage element or accessory, if desired.

Figure 4:
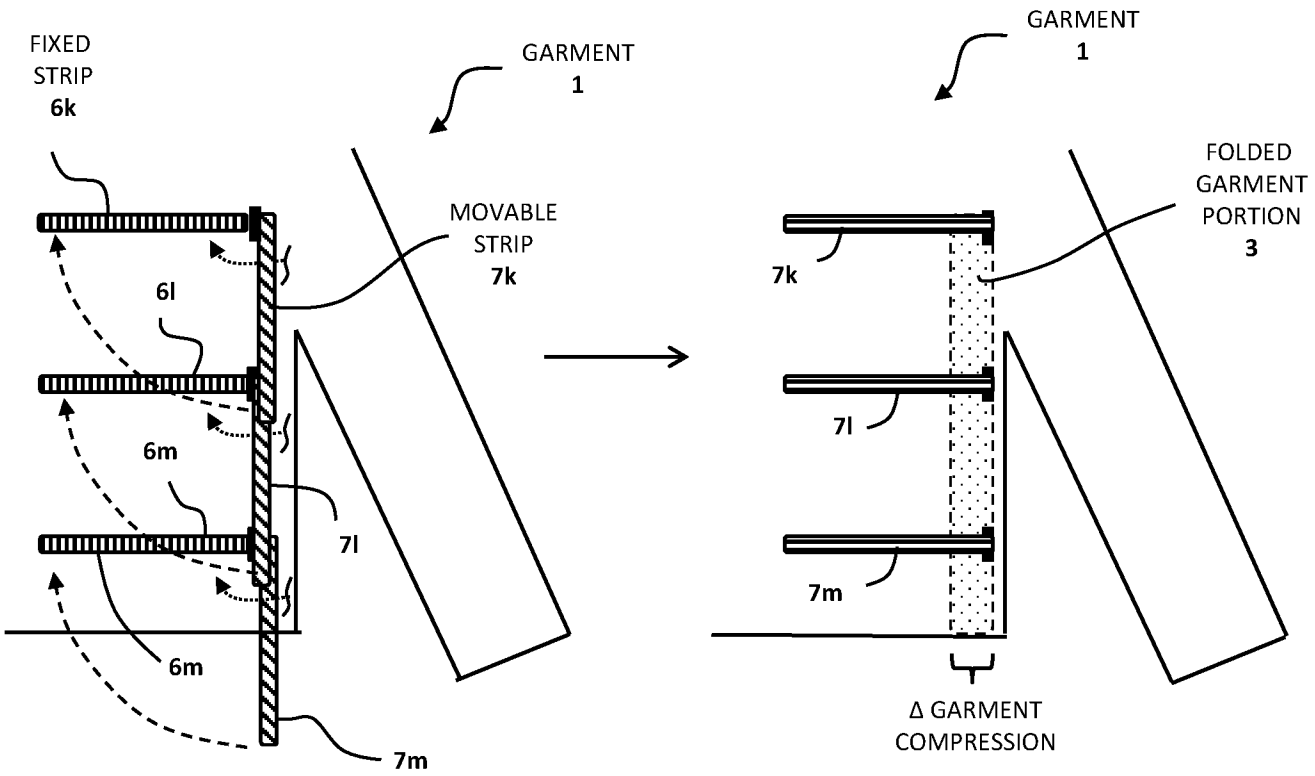
FIG. 4 illustrates a process for using three fastening elements to gather a folded garment portion 3 in compression of the garment 1 against the trunk of a user, thereby illustrating a second function of this embodiment of the invention.

Turning now to FIG. 4, there is shown a process for adjusting the fit or compression of the garment 1 using fastening elements on the right side of the trunk of the garment 1 from the perspective of the viewer. As noted hereinabove, a useful feature of the fastening elements of this embodiment and other embodiments of the invention is the mechanism for compressing an oversized garment to the body of a wearer when a bulky under-layer is not being worn to provide extra insulation. This feature allows the garment to be used in all seasons because it is sufficiently oversized to accommodate a relatively bulky and warm under-layer in cold seasons and to be compressible to provide a relatively close fit in warmer seasons when the under-layer is not being worn under the garment. FIG. 4 shows the adjustment of the garment 1 in a situation where the under-layer is absent, and the user wishes to adjust and compress the garment 1 while it is being worn. Although not specifically demonstrated herein, a similar compressing mechanism may be applied to the arms, shoulders and hood as well as the waist and legs of lower body garments, if desired and if fastening elements are provided at those locations.

On the right side of FIG. 4, the three fastening elements each are arranged with the fixed strips 6*k*, 61 and 6*m* extending horizontally across the trunk of the garment 1 and the corresponding movable strips 7*k*, 71 and 7*m* of the fastening elements are hanging vertically. As indicated by the dashed arrows, the movable strips 7*k*, 71 and 7*m* are pulled towards the center of the trunk. This allows the user to gather excess fabric of the trunk of the garment 1 and fold it inward prior to fastening the movable strips 7*k*, 71 and 7*m* to the fixed strips 6*k*, 61 and 6*m*. When the fastening is complete, a folded garment portion 3 (represented by the area within the dashed rectangle) is gathered and fixed against the trunk of the user. This particular case shows adjustment of the trunk portion of the garment 1. Advantageously in this case, the anchored ends of the fastening elements are located substantially adjacent to the lateral side of the trunk to facilitate gathering of fabric at the lateral side. For example, with an anchored end of a movable strip on the left side of the trunk, the user would pull the movable strip outward, create a fold of the garment below the fixed strip and then pull the free end of the movable strip to across to the far end of the fixed strip and then fasten the fixed and movable strips together. The ability to compress the garment using the fastening elements in the arrangement described is particularly useful in sport hunting pursuits such as bow hunting where a loose-fitting garment might interfere with the motion of drawing a bow string.

Embodiment 2—Upper Body Garment with Shorter Fastening Elements on Lateral Front Torso A second embodiment of a garment 300 is now described with reference to FIGS. 5 to 7. This garment embodiment 300 was developed with the recognition that provision of garment torso adjustment functionality can be addressed using shorter lateral fastening elements. An overview of the garment embodiment is described with respect to FIGS. 5A and 5B and the features and operation of the fastening elements 350*a-n* is described with respect to FIGS. 6 and 7.

Figure 5A:
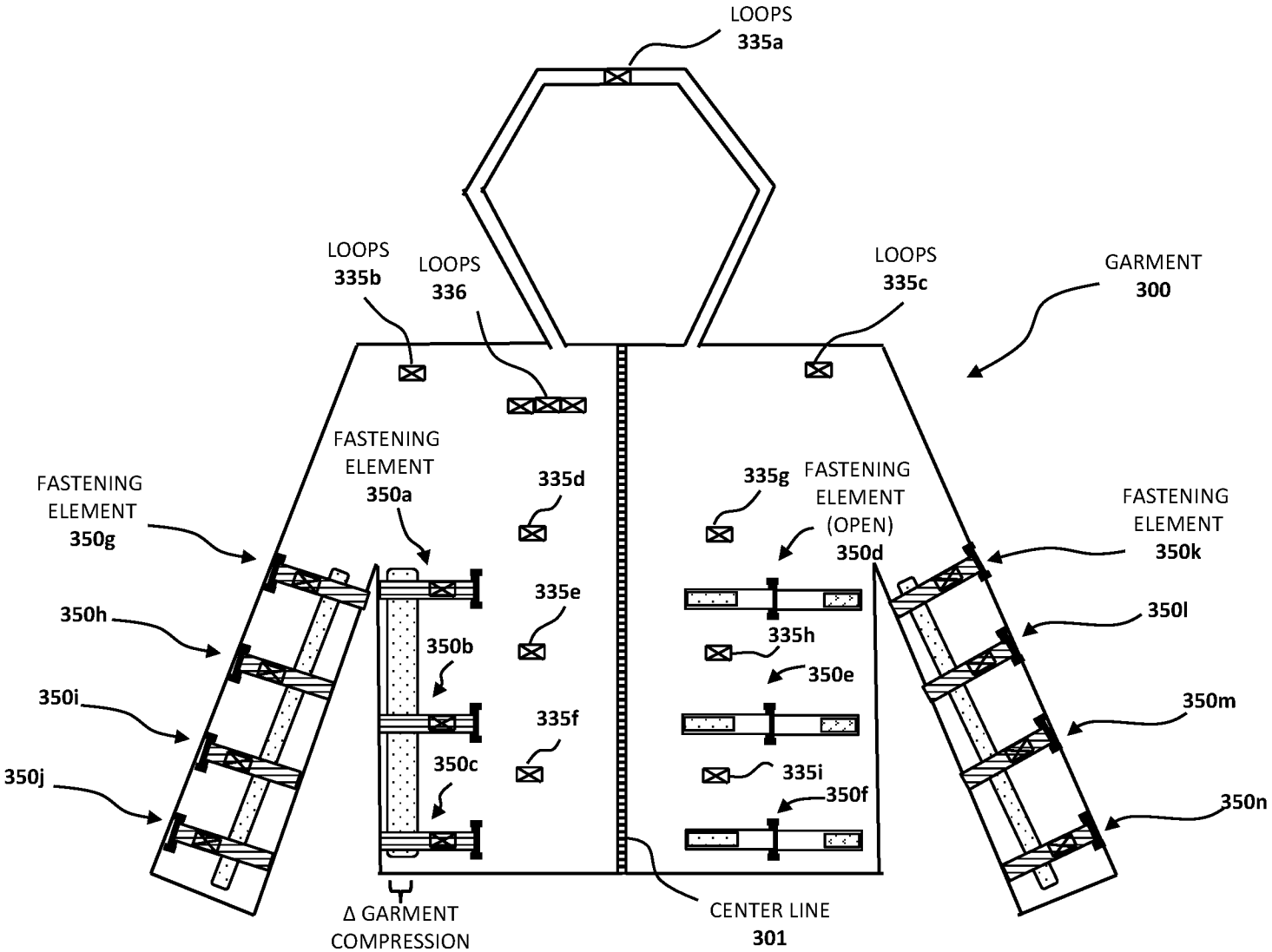
FIG. 5A is an illustration of another embodiment of a garment 300 with a plurality of fastening elements 350*a-n* and showing garment compression in selected portions of the garment 300.

FIG. 5A is an illustration of garment 300 prior to attachment of camouflage elements. It is seen that this embodiment of the garment 300 has six fastening elements 350*a-f* arranged on the torso portion of the garment 300 with three fastening elements 350*a-c* on the left and three fastening elements 350*d-f* on the right. Fastening elements 350*a-c* are in the fastened position with garment compression on the torso portion indicated in a manner similar to the garment folding and compression shown in FIG. 4, which is applied when the oversized garment is worn without a substantial mid-layer in warmer weather conditions. Fastening elements 350*d-f* are in the open position to illustrate functionality and do not provide garment compression on the torso portion in this position. Fastening elements 350*g-j* on the left sleeve of the garment 300 are closed and indicate sleeve compression. Fastening elements 350*k-n* on the right sleeve of the garment 300 are also closed and indicate sleeve compression.

It is seen in FIG. 5A that the three fastening elements 350*a-c* of the torso portion of the garment 300 extend between the lateral seam of the garment 300 (to be interpreted as the lateral edge of the garment 300 in the view shown) to approximately a mid-point between the front center line 301 of the garment 300. Fastening elements 350 orientated in this manner relative to the garment provide sufficient adjustability to make a two- to three-fold size adjustment, for example, extra-large, to large and extra-large to medium. Such an adjustment requires compression or folding of the torso portion of the garment by up to about 3 inches on each side. This modification of the fastening elements 350*a-f* of garment 300 relative to the first garment embodiment 1 where the fastening elements 5*h*-5*m* extend across a majority portion of the front of the garment 1, makes additional space available on the front of the garment 300 for six additional loops 335*d-i* connected directly to the garment 300. These six additional loops 335*d-i* do not provide garment adjustment functionality, but can be used for attachment of camouflage elements C, or accessories A-1, A-3 as shown in FIG. 5B. In this particular embodiment, these six additional loops 335*d-i* as well as the upper garment loops 335*a-c* and 336 are formed of elastomeric material arranged in a criss-cross pattern. Different types of loops formed of different materials may be used in alternative embodiments. In this embodiment, loops 335*d-i* are located between the medial ends of the fastening elements 350*a-f* and the front center line 301 of the garment 300 and horizontally offset from the fastening elements 350*a-f* in order to minimize interference of connected camouflage elements and/or accessories therewith when sizing adjustments are being made using the fastening elements 350*a-f*. The loops 335*d-i* may be arranged in different orientations in alternative embodiments.

Figure 5B:
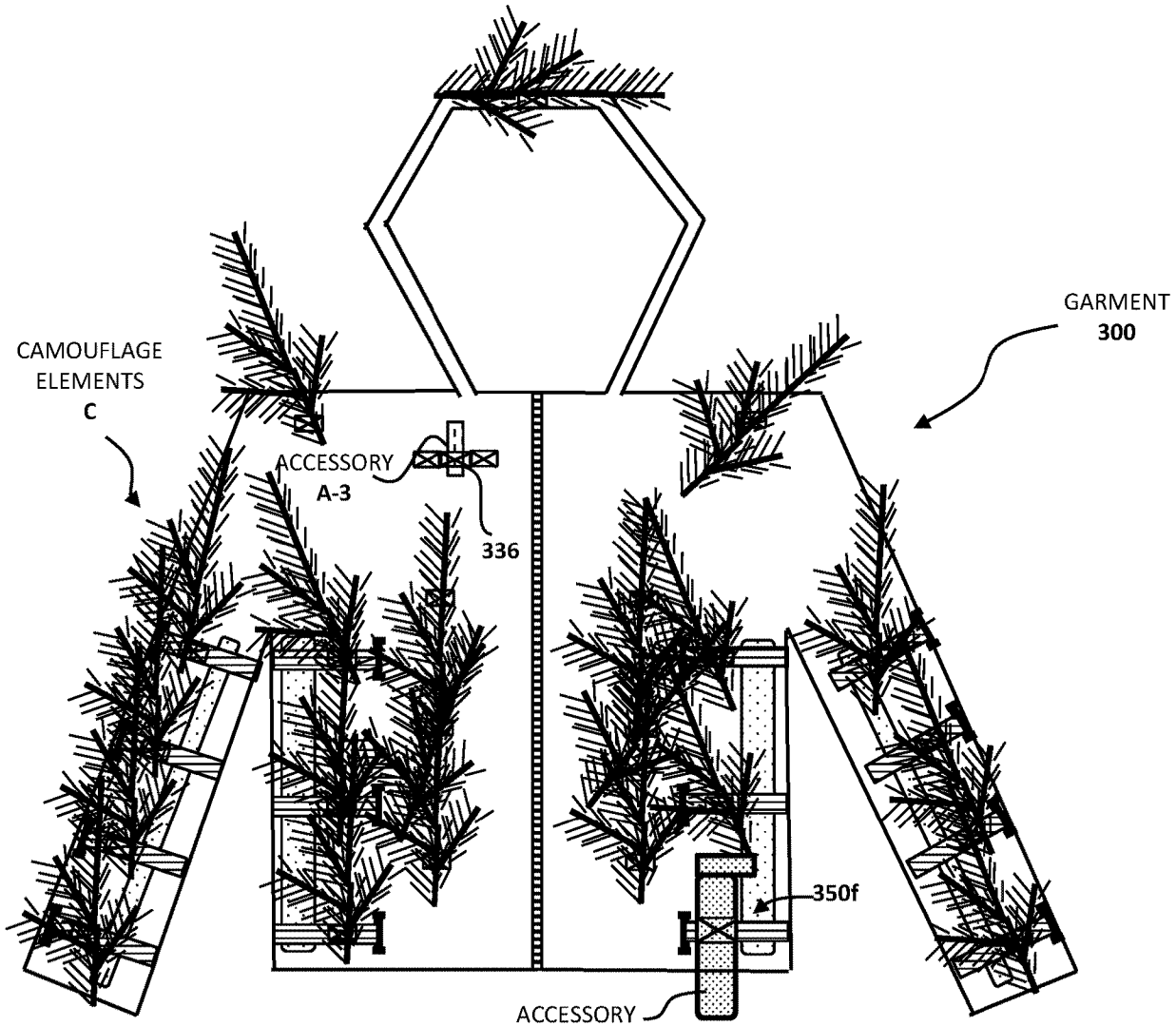
FIG. 5B is an illustration of the garment 300 of FIG. 5A shown with attached camouflage elements C.

FIG. 5B, which indicates camouflage elements C attached to garment 300, is identical to FIG. 5A, with the exception that the torso fastening elements 350*d-f* are closed with torso garment compression indicated, and with most reference numerals omitted to preserve clarity. Camouflage elements C are indicated as being attached using all of the fastening elements 350*a-n* as well as the loops 335*a-i* in most cases. Accessory A-2 (a canister of bear pepper spray) is shown attached to an unlabeled outer loop of fastening element 350*f* and accessory A-3 (a deer call) is shown attached to loop 336. Loop 336 is located near the neck of the garment 300 to facilitate hands-free operation of accessory A-3. In this position, the deer call A-3 may be operated in a hands-free manner by blowing down into its mouth-piece while it remains attached to loop 336. This is particularly advantageous when a bow hunter wearing the garment 300 is drawing the string of the bow and wishes to use the deer call at the same time.

Figures 6, 7:
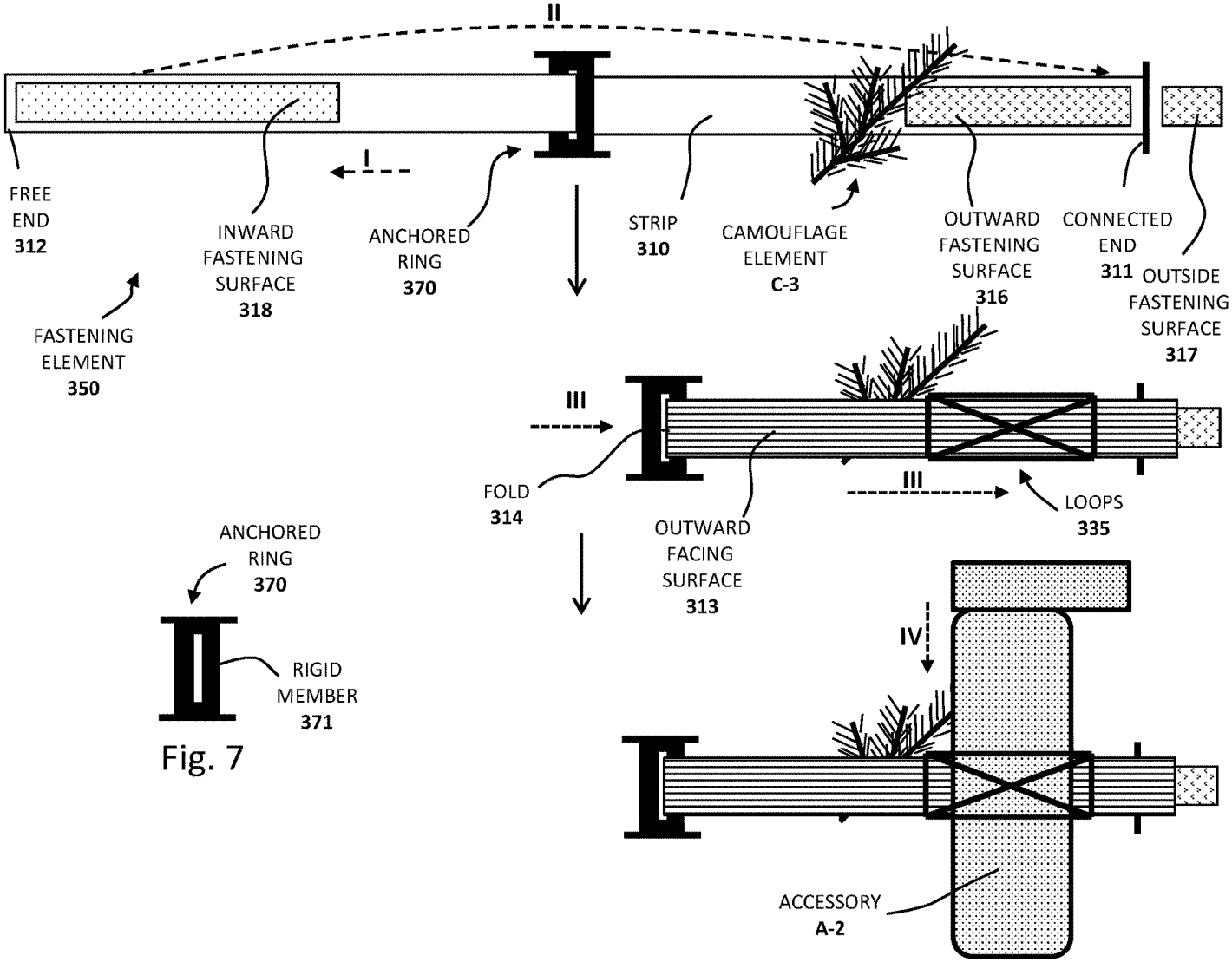
FIG. 6 is an illustration of operation of a fastening element 350.
FIG. 7 is an illustration of the anchored ring 370 of the fastening element shown in FIG. 6.

FIG. 6 illustrates additional features and operation of a fastening element labelled as 350. Fastening element 350 is a representation of each the fastening elements 350*a-n* of the garment 300 (including the fastening elements 350*a-f* of the torso portion and fastening elements 350*g-n* of the sleeves) which all function in a similar manner.

The general fastening element 350 of FIG. 6 includes a strip 310 formed of flexible and durable material. In order to provide the ability to make appropriate sizing adjustments of the garment 300, it is advantageous to provide the strip 310 with a length corresponding to about 75% of the distance between a lateral seam and the front center line of the garment 300. In one embodiment the strip 310 is about 9 inches long for an upper body garment having a distance of about 12 inches between the center line 301 and the lateral seam.

The strip 310 is connected to the outer surface of the garment 300 at one connected end 311 by stitching, rivets or other conventional attachment mechanisms for connecting materials to garments. In this particular embodiment, this connection holds approximately a 0.25 inch portion of the strip 310 against the surface of the garment 300. The remainder of the strip 310 is free and movable. An outward fastening surface 316 is provided adjacent to the connected end 311 and an inward fastening surface 318 is provided adjacent to the free end 312 which is grasped and pulled during operation of the fastening element 350. The fastening surfaces 316 and 318 can be formed of any material capable of forming a fastening connection, such as conventional hook and loop surfaces, for example.

A ring 370 is anchored to the garment 300 using a conventional attachment mechanism. This anchored ring 370 is shown by itself in FIG. 7. The purpose of the ring 370 is to provide a rigid member 371 as a point of leverage for pulling a folded part of the garment 300 when making size adjustments using the fastening element 350 as described below.

The free end 312 of the strip 310 is threaded through the opening of the ring 370. An additional outside fasting surface 317 is connected to the garment 300 to the right of the strip 310. In some embodiments, the connected end 311 is at or adjacent to a lateral seam of the garment 300 and the outside fastening surface is connected to the garment on the other side of the lateral seam (the back of the garment 300). This outside fastening surface 317 is provided to allow further tightening and retention of the fastening element 350.

In FIG. 6, the operations used to make a torso compression adjustment of the garment 300 using fastening element 350 while fastening a camouflage element C-3 and an accessory A-2 are illustrated. These manual operations are indicated with dashed arrows and Roman numerals I to IV. Camouflage element C-3 is placed against the strip 310 to the right of the ring 370. Then the free end 312 of the strip 310 is pulled towards the left to extend the free end 312 leftward as shown with the dashed arrows and Roman numeral I and then pulled to the right as shown with Roman numeral II. This movement provides the effect of pulling the anchored ring 370 to the right, thereby pulling excess material of the garment 300 and creating a fold in the garment 300 (creating compression of the garment 300 against the body of the wearer). To retain the fold in the garment 300, the inward fastening surface 318 of the strip 310 is connected to the outward fastening surface 316 of the fixed strip 310 as indicated by Roman numeral III, holding in place the camouflage element C-3. In this arrangement, shown in the middle of the process, it is seen that a set of loops 335 is provided on the outward facing surface 313 of the strip 310.

For the torso portion, this procedure may be performed using the left hand to manipulate fastening elements 350 on the left side of the torso. This includes first pulling the strip 310 medially to create the fold 314 in the strip 310 against the rigid member 371 of the ring 370 and then pulling the strip 310 laterally to fasten the inward fastening surface 318 of the strip 310 to the outward fastening surface 316 of the strip 310. Likewise, the right hand is used to make similar manipulations on the right side of the torso. In this embodiment, the fastening elements 350*g-n* of the sleeves are arranged in an opposing manner and are operated using opposing hands. The left sleeve adjustment is made using the right hand and the right sleeve adjustment is made using the left hand. In each case, the strip 310 is pulled laterally first and then pulled medially before attaching the inward fastening surface 318 of the strip 310 to the outward fastening surface 316 of the strip 310. This arrangement is advantageous because pulling medially from the opposite side of the torso is physically easier than pulling laterally from the opposite side of the torso.

Lastly, accessory A-2 is connected to the fastening element 350 by stretching the elastomeric loops 335 and placing the accessory therewithin (Roman numeral IV).

Figure 8:
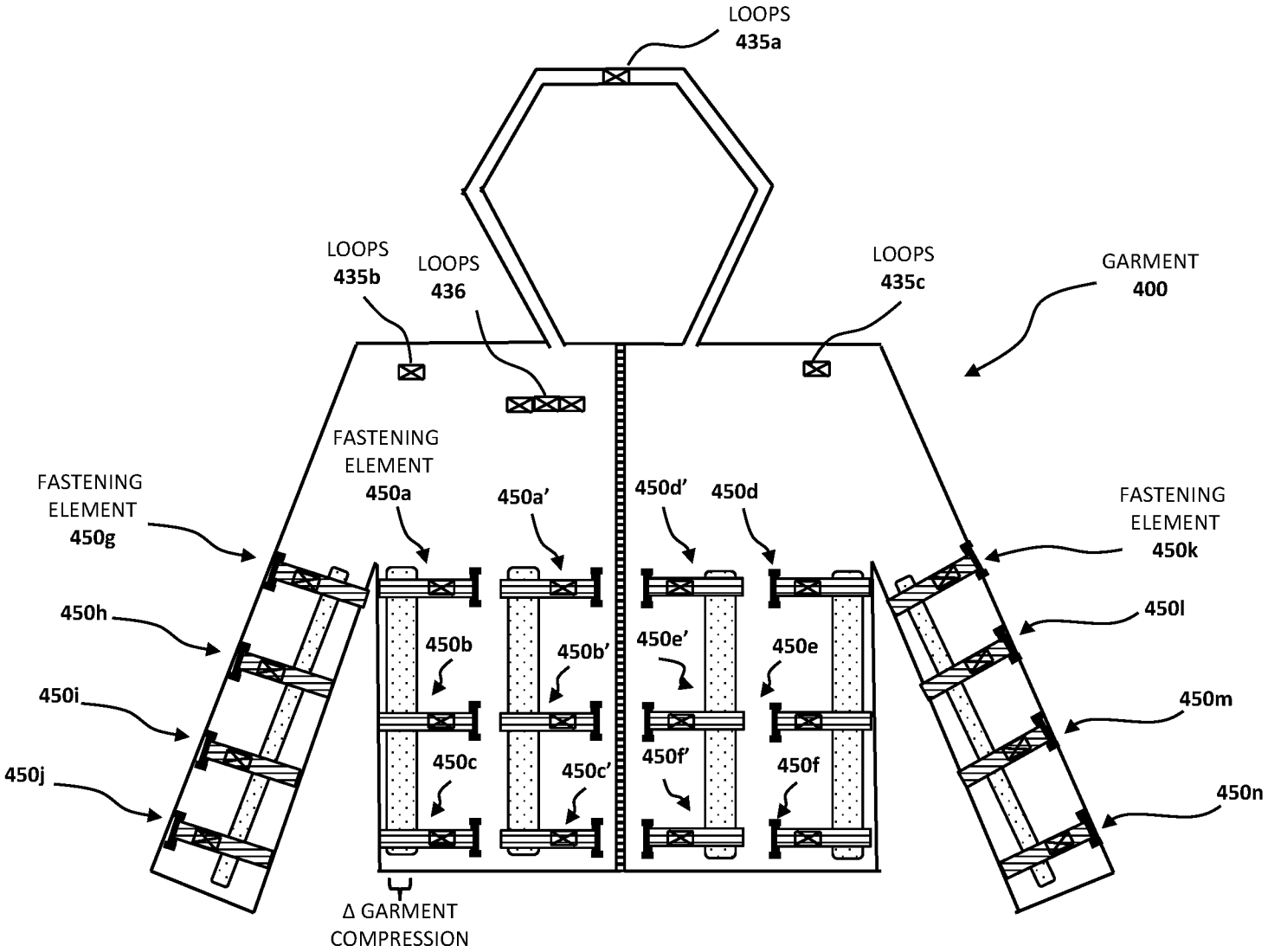
FIG. 8 is an illustration of another embodiment of a garment 400 with a plurality of and fastening elements 450*a-n* and 450*a*'-f' and showing garment compression in selected portions of the garment 400.

Embodiment 3—Garment with Four Columns of Fastening Elements on the Front Torso Another embodiment of a garment 400 having four columns of fastening elements on the front torso is shown in FIG. 8. The construction of the fastening elements 450*a*-450*n* is generally the same as the fastening elements 350*a-n* shown in FIGS. 5A and 5B and fastening element 350 of FIG. 6. However, in this embodiment, there are two columns of fastening elements on each side of the front torso as shown. Lateral fastening elements 450*a-f* are shown in the closed position and arranged in orientations similar to those of fastening elements 350*a-f* in FIG. 5A and are adjacent to fastening elements 450*a*'-f'. This arrangement provides additional sizing adjustability at the front of the torso of the garment, as needed by the wearer. All fastening elements 450*a-n* include loops on their outward facing surfaces to provide further connection points for additional camouflage elements and/or accessories.

Alternative Embodiments

A number of alternatives to the example embodiments illustrated herein are within the scope of the invention. Fastening elements of the illustrative embodiment are connected permanently to the garment. In alternative embodiments a fastening element kit is provided separate from the garment with instructions for connecting the fastening elements to the garment using connecting means which are optionally provided with the kit. Such kits may be provided to garment manufacturers for assembly of garments according to embodiments described herein.

Fastening elements of the illustrative embodiment are formed from a combination of a fixed strip and one or two movable strips. Alternative embodiments are formed from cords with one or more fixed or floating adjustment mechanisms, such as barrel cord locks, for example, which are used to form cord loops to hold camouflage elements and/or accessories. Such alternative embodiments may also be used to compress excess garment fabrics as described above. Secondary adjustment mechanisms may be provided by additional cords connected to a main cord loop to provide secondary loops. The secondary loops may likewise be provided with fixed or floating adjustment mechanisms.

While the example embodiments are focused on an upper body garment, similar principles and fastening elements and loops may be applied to lower body garments such as pants, for example. In addition, while the example embodiments focused on the front of the garment, similar fastening elements may be provided on the back portions of the garment. In certain alternative embodiments, the loops and/or fixed strips may themselves be permanently connected to an additional piece of material which is then attached to the garment using a separate connection mechanism such as a hook and loop system. This may be helpful in situations where an individual wearing a garment wishes to have the option of placing fastening elements for camouflage elements on the back of a garment and then to remove such fastening elements as required if a backpack is to be worn. Likewise, certain removable fastening elements close to the shoulders may also be removed if a backpack is to be worn.

In some embodiments, the garment is provided with a standard camouflage pattern selected to be generally compatible with added camouflage elements attached using loops and fastening elements.

In some embodiments, the garment has an outer waterproof shell that can be worn over the hunters existing base and mid layer clothing as part of a complete hunting outfit. This allows the hunter to continue to wear other clothing and have the benefit of an infinite number of camouflage patterns.

Advantages

Bowhunting occurs in the spring for bears and turkeys and in the late summer to winter for elk, moose, deer, coyotes and wolves. Adding or removing layers of clothing is essential for warmth and comfort during all seasons. Embodiments of the upper body garment described herein have fastening elements which simultaneously function to attach camouflage elements and make sizing adjustments. In some of the embodiments described herein, these fastening elements are strategically positioned at the bottom, mid body and upper torso providing adjustment for extra clothing layers and body types. The fastening elements can create more room in the waist, abdomen and chest.

In the embodiments of the upper body garment, fastening elements are positioned on the sleeves. This provides sleeve sizing adjustment to keep the sleeve fabric on the bow holding arm tight to the skin during bow hunting to prevent the bow string from catching the sleeve fabric and causing an erroneous shot which may wound an animal or cause injury to the bow hunter.

The main strip of a fastening element may be disengaged from its ring and accessories having their own belt loops can be placed on the strip in the same manner as they are installed on a conventional waist belt. In this manner, accessories like sheathed knives, sheathed bear pepper spray holders and other tools may be conveniently secured to the garment for convenient access.

Traditional camouflage varies between different patterns based on different environments and backgrounds. Embodiments of the garment have several strategically placed loops and fastening elements that allow the hunter to "attach" natural elements such as twigs, branches and grass, among others) to match the foliage and natural features of the hunting area with a single size-adjustable camouflage garment which provides depth and a 3D perspective which is lacking in a traditional fabric-based camouflage pattern.

Another issue that hunters face is scent control. Animals have an extremely heightened sense of smell. Hunters pay high prices for outfits with scent eliminating fabrics, body sprays and wipes to eliminate human odor and in some cases very expensive electronic devices that cover their scent with ozone. By attaching natural foliage from the environment, the smell of the hunter will be masked. The act of pruning foliage to attach to the garment releases the scent of that foliage.

Another benefit to attaching natural foliage to a garment is that is sounds more natural when a hunter walks through the woods. Twigs and branches brushing against fabric makes an unnatural sound which tends to alert the animals being hunted.

EQUIVALENTS AND SCOPE

Other than described herein, or unless otherwise expressly specified, all of the numerical ranges, amounts, values and percentages, such as those for amounts of materials, elemental contents, times and temperatures, ratios of amounts, and others, in the following portion of the specification and attached claims may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Any patent, publication, internet site, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Unless otherwise defined, all technical and scientific terms used herein have the same meaning as commonly understood by one of ordinary skill in the art to which this invention belongs.

While this invention has been particularly shown and described with references to embodiments thereof, it will be understood by those skilled in the art that various changes in form and details may be made therein without departing from the scope of the invention encompassed by the appended claims.

In the claims, articles such as "a," "an," and "the" may mean one or more than one unless indicated to the contrary or otherwise evident from the context. Claims or descriptions that include "or" between one or more members of a group are considered satisfied if one, more than one, or all of the group members are present in, employed in, or otherwise relevant to a given product or process unless indicated to the contrary or otherwise evident from the context.

It is also noted that the term "comprising" is intended to be open and permits but does not require the inclusion of additional elements or steps. When the term "comprising" is used herein, the term "consisting of" is thus also encompassed and disclosed. Where ranges are given, endpoints are included. Furthermore, it is to be understood that unless otherwise indicated or otherwise evident from the context and understanding of one of ordinary skill in the art, values that are expressed as ranges can assume any specific value or subrange within the stated ranges in different embodiments of the invention, to the tenth of the unit of the lower limit of the range, unless the context clearly dictates otherwise. Where the term "about" is used, it is understood to reflect +/−10% of the recited value. In addition, it is to be understood that any particular embodiment of the present invention that falls within the prior art may be explicitly excluded from any one or more of the claims. Since such embodiments are deemed to be known to one of ordinary skill in the art, they may be excluded even if the exclusion is not set forth explicitly herein.

The invention claimed is:

1. A size-adjustable garment comprising:

a plurality of fastening elements configured to simultaneously provide for adjusting a size of the garment and to provide for attachment of camouflage elements or accessories, wherein at least some of the plurality fastening elements comprise:

a strip of flexible material connected to the size-adjustable garment at a first end and having a free second end, the strip of flexible material having an outward fastening surface adjacent to the first end and an inward fastening surface adjacent to the free second end, wherein the outward and the inward fastening surfaces become fastenable to each other when a fold is made in the strip of flexible material between the first end and the free second end;

a rigid member anchored to the size-adjustable garment in an arrangement permitting the fold in the strip of flexible material to be made around the rigid member such that the free second end is able to be pulled towards the first end as the strip of flexible material rolls over the rigid member, the rigid member being pulled towards the first end of the strip of flexible material, thereby causing folding of a portion of the size-adjustable garment between the rigid member and the first end of the strip of flexible material;

wherein the strip of flexible material further comprises a secondary attachment mechanism comprising one or more loops; and wherein the one or more loops are formed of elastomeric material connected to the outward facing surface of the strip of flexible material.

2. The size-adjustable garment of claim 1, wherein the secondary attachment mechanism holds one or more additional camouflage elements or accessories against the outward facing surface of the strip of flexible material when the outward and the inward fastening surfaces are fastened.

3. The size-adjustable garment of claim 1, wherein the one or more loops are formed from opposed slits formed in the strip of flexible material.

4. The size-adjustable garment of claim 1, wherein the outward and the inward fastening surfaces are complementary fastening surfaces.

5. The size-adjustable garment of claim 4, wherein the complementary fastening surfaces are hook and loop fastening surfaces.

6. The size-adjustable garment of claim 1, wherein the rigid member is part of a square or rectangular ring anchored to the size-adjustable garment.

7. The size-adjustable garment of claim 1, wherein an additional segment of outward fastening surface material is attached to the size-adjustable garment adjacent to the first end of the strip of flexible material for fastening to the inward fastening surface of the strip of flexible material if the fold permits the free second end to extend beyond the first end.

8. The size-adjustable garment of claim 1, wherein the plurality of fastening elements comprises two vertical columns parallel to each other having three fastening elements each on one side of a front torso portion of the size-adjustable garment and two vertical columns parallel to each other having three fastening elements each on an opposite side of the front torso portion of the size-adjustable garment.

9. A method for adjusting the size of the size-adjustable garment of claim 1 against a part of a body of an individual wearing the size-adjustable garment, the method comprising:

grasping the free second end of the strip of flexible material;

wrapping the strip of flexible material around the rigid member to create the fold and pulling the free second end to pull the rigid member towards the first end of the strip of flexible material, thereby folding and compressing the size-adjustable garment against the body of the individual; and fastening the inward fastening surface to the outward fastening surface.

10. The method of claim 9 further comprising:

placing at least one of a camouflage element or an accessory between the inward fastening surface and the outward fastening surface prior to fastening, thereby attaching at least one of the camouflage element or the accessory to the size-adjustable garment.

11. A size-adjustable garment comprising:

a plurality of fastening elements, wherein at least some of the plurality of fastening elements comprise:

a strip of flexible material connected to the size-adjustable garment at a first end and having a free second end, the strip of flexible material having an outward fastening surface adjacent to the first end and an inward fastening surface adjacent to the free second end, wherein the outward and the inward fastening surfaces become fastenable to each other when a fold is made in the strip of flexible material between the first end and the free second end;

a rigid member anchored to the size-adjustable garment in an arrangement permitting the fold in the strip of flexible material to be made around the rigid member such that the free second end is able to be pulled towards the first end as the strip of flexible material rolls over the rigid member, the rigid member being pulled towards the first end of the strip of flexible material, thereby causing folding of a portion of the size-adjustable garment between the rigid member and the first end of the strip; and wherein the size adjustable garment is an upper body garment, wherein the plurality of fastening elements comprises six fastening elements with three fastening elements of the six fastening elements are arranged in a vertical column on each side of a front torso portion of the upper body garment.

12. The size-adjustable garment of claim 11, further comprising four additional fastening elements of the plurality of fastening elements on each sleeve of the upper body garment.

13. The size-adjustable garment of claim 11, further comprising a plurality of additional loops located medially with respect to the three fastening elements of the plurality of fastening elements on each side of the front torso portion.

14. The size-adjustable garment of claim 11, further comprising a plurality of upper loops located on a chest portion and a shoulder portion of the upper body garment.

15. The size-adjustable garment of claim 11, further comprising a loop located on an upper chest portion of the upper body garment for connection of an animal call device to enable hands-free operation of the animal call device.

16. The size-adjustable garment of claim 11, further comprising a side seam and a centerline, wherein the side seam and the centerline are positioned apart by a distance of about 11 to about 13 inches, and, wherein the strip of flexible material for each fastening element of the plurality of fastening elements of the front torso portion has a length of about 8 to about 10 inches.

17. The size-adjustable garment of claim 11, wherein the rigid member of the plurality of fastening elements is formed of metal or plastic.

* * * * *